US007826756B2

(12) United States Patent
Bae

(10) Patent No.: US 7,826,756 B2
(45) Date of Patent: Nov. 2, 2010

(54) METHOD FOR CONTROLLING IMAGE FORMING APPARATUS

(75) Inventor: Jun Cheol Bae, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 136 days.

(21) Appl. No.: 12/242,452

(22) Filed: Sep. 30, 2008

(65) Prior Publication Data

US 2009/0175634 A1 Jul. 9, 2009

(30) Foreign Application Priority Data

Jan. 4, 2008 (KR) ..... 10-2008-0001096

(51) Int. Cl.
*G03G 15/00* (2006.01)
*G03G 15/08* (2006.01)

(52) U.S. Cl. ..... 399/49; 399/50; 399/55; 399/72

(58) Field of Classification Search ..... 399/27, 399/49, 50, 53, 55, 72
See application file for complete search history.

(56) References Cited

U.S. PATENT DOCUMENTS 5,860,038 A * 1/1999 Kato et al. ..... 399/49
5,970,280 A * 10/1999 Suzuki et al. ..... 399/55
2006/0110174 A1* 5/2006 Ishida ..... 399/49 X
2007/0047981 A1* 3/2007 Ishida ..... 399/27

FOREIGN PATENT DOCUMENTS

JP 2002-162795 6/2002

OTHER PUBLICATIONS

Machine English language translation of JP 2002-162795, published Jun. 7, 2008.

* cited by examiner

*Primary Examiner*—Sophia S Chen
(74) *Attorney, Agent, or Firm*—Stanzione & Kim, LLP

(57) ABSTRACT

A method for controlling an image forming apparatus is disclosed. An image pattern is developed both by a DC developing process using a developing bias voltage of only a DC voltage and by an AC+DC developing process using a developing bias voltage of a DC voltage overlapped with an AC voltage. The densities of the two developed image patterns is compared with each other to implement toner density control.

20 Claims, 5 Drawing Sheets

METHOD FOR CONTROLLING IMAGE FORMING APPARATUS

CROSS-REFERENCE TO RELATED APPLICATION

This application claims the benefit of Korean Patent Application No. 2008-0001096, filed on Jan. 4, 2008 in the Korean Intellectual Property Office, the disclosure of which is incorporated herein by reference.

BACKGROUND OF THE INVENTION

1. Field of the Invention

The present invention relates to a method for controlling an image forming apparatus, and more particularly, to a method for controlling an image forming apparatus for forming a black and white image or a color image, which senses density of an image pattern formed on a photosensitive body or a transfer body by use of a density sensor, and controls an image forming condition according to the sensed result.

2. Description of the Related Art

An image forming apparatus generally prints either a black and white image or a color image, by scanning a light on a photosensitive body charged to a predetermined electric potential to form an electrostatic latent image, developing the electrostatic latent image using toner, and transferring and fusing the developed toner image onto paper.

In a case where an image forming apparatus is configured to print a color image, multiple color toners, typically, yellow (Y), magenta (M), cyan (C) and black (K) are used. That is, four developing devices may be needed for forming toner images of four colors. There are, broadly speaking, two types of color image forming apparatuses, one of which is a single pass type having four pairs of exposure units and photosensitive bodies, the single color toner image produced by each pair are overlapped with images of other pairs to produce the color image, while the other type being a multi-pass type which is provided with a single exposure unit and a single photosensitive body.

Several different types of developer are available for use in an image forming apparatus, including, for example, a wet type developer that includes powder type toner particles dispersed in a liquid type carrier, a dry type developer, including, e.g., two-component developer, in which non-magnetic toner particles are mixed with magnetic carriers, one component developer with either magnetic or non-magnetic toner particles, or the like.

In an image forming apparatus using dry type developer, e.g., two component developer, because the electrostatic latent image is developed by the use of only the toner particles, it may be of a particular importance to properly control the supply of the toner to maintain the toner density within an adequate range.

One control method conventionally used to control the toner density is to sense the toner density of an image pattern formed on a photosensitive medium or a transfer belt, and using the sensed toner density to control the supply of the toner. An example of such a conventional toner density control method is disclosed in Japanese Patent Laid-open Publication No. 2002-162795 to Makoto et al. ("Makoto"). According to the conventional toner density control method described by Makoto, a reference image pattern is first developed, and then density of the image pattern is sensed, and a determination is made as to whether the density of the image pattern is higher or lower than preset reference density. If it is determined that the density of the image pattern is lower than the preset reference density, additional toner is supplied to the developing unit.

However, in an image forming apparatus using dry type developer, e.g., two-component type developer, with the increased level of charge of the developer, a less amount of toner may be supplied to the photosensitive body. For this reason, even when a sufficient amount of toner exists in the developing unit, the amount of toner supplied to the photosensitive body may be lower than the reference value. In this situation, if the additional toner is supplied to the developing unit to adjust the density of the image pattern according to the conventional control method, an excessive toner supply may occur, in which the relative amount of toner without sufficiently charge becomes proportionally large, which in turn may result in toner scattering phenomenon and/or background contamination.

BRIEF DESCRIPTION OF THE DRAWINGS

Various aspects and advantages of the embodiments of the invention will become apparent and more readily appreciated from the following description of the embodiments, taken in conjunction with the accompanying drawings, of which.

DETAILED DESCRIPTION OF SEVERAL EMBODIMENTS

Figure 1:
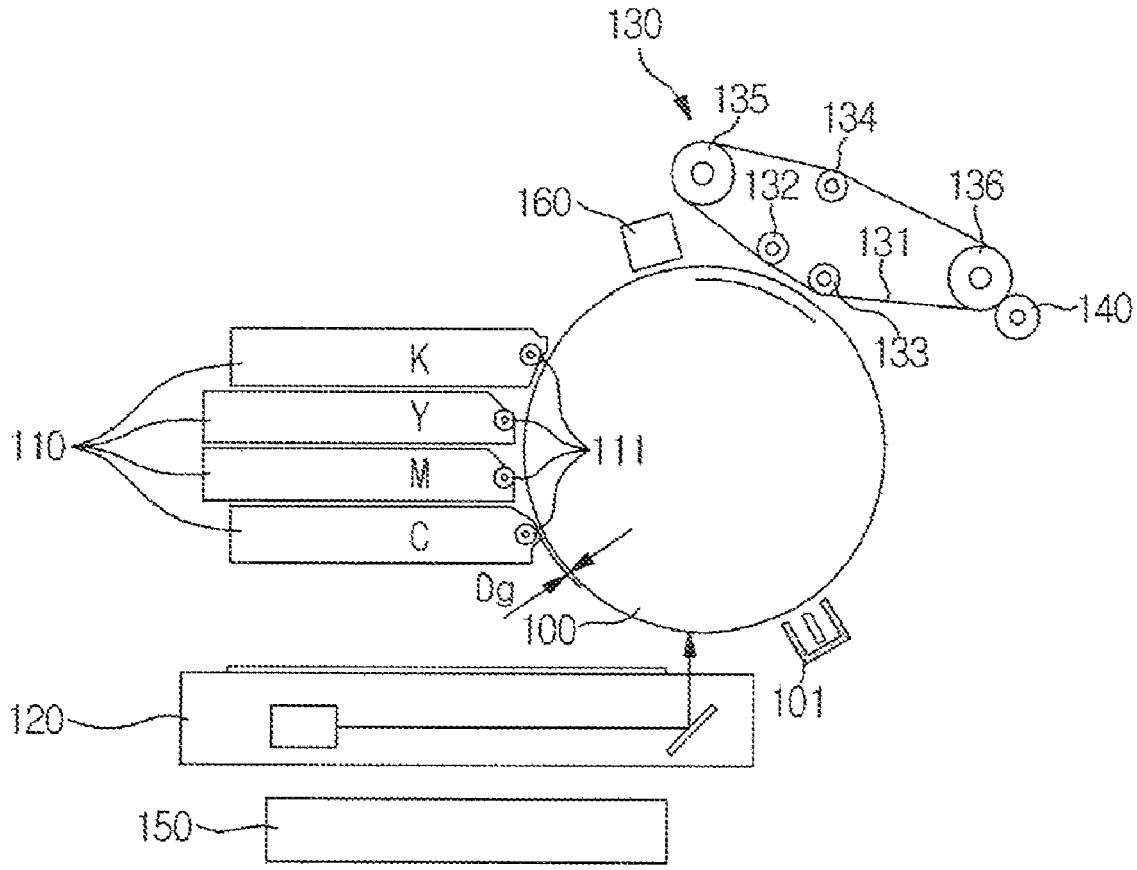
FIG. 1 is a constitutional view schematically showing a multi-pass type image forming apparatus according to an embodiment of the present invention.

Reference will now be made in detail to exemplary embodiments of the present invention, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail.

FIG. 1 is a view schematically showing the relevant constitution of a multi-pass type image forming apparatus according to an embodiment of the present invention.

As shown in FIG. 1, an image forming apparatus according to the embodiment may comprise a photosensitive medium 100, four developing units 110, an exposure unit 120, an intermediate transfer unit 130, a transfer roller 140, a power supply source 150 and a density sensing part 160.

The photosensitive medium 100 may include a cylindrical metallic drum and a photo-conductive layer formed on the outer circumferential surface of the drum. When forming an image, the photosensitive medium 100 may be made to exhibit 3 voltage levels, i.e., a surface voltage, a non-latent image voltage and a latent image voltage, according to the exposure to the light from the exposure unit 120. Hereinafter, the photosensitive medium 100 will be referred to as a photosensitive drum 100.

A charging unit 101 charges the photosensitive drum 100 to a uniform electric potential. The charging unit 101 may be configured as a charging roller or a corona charging unit. The charging unit 101 supplies electric charges to the photosensitive drum 100, by either contacting, or not contacting, the outer surface of the photosensitive drum 100, so that the outer surface of the photosensitive drum 100 is charged to a uniform electric potential.

Four developing units 110 respectively store solid powder type toners of different colors, e.g., cyan (C), magenta (M), yellow (Y) and black (K). The developing units 110 oppose the photosensitive drum 100, and are arranged in sequence in a rotating direction of the photosensitive drum 100. Four developing units 110 respectively include developing rollers 111, so as to supply the toner to an electrostatic latent image formed on the photosensitive drum 100, and to develop the electrostatic latent image into a toner image. According to an embodiment, each of the developing rollers 111 of the developing units 110 may be positioned to have a developing gap Dg with the outer surface of the photosensitive drum 100.

The exposure unit 120 may be mounted below the photosensitive drum 100. The exposure unit 120 scans light corresponding to image information to the photosensitive drum 100 charged to a uniform electric potential, thereby forming the electrostatic latent image. The exposure unit 120 may be configured as a laser scanning unit, which uses a laser diode as the light source.

The intermediate transfer unit 130 may include a transfer belt 131, and a plurality of supporting rollers 132, 133, 134, 135 and 136 to rotatably support the transfer belt 131. The transfer belt 131 opposes the photosensitive drum 100 in the section, e.g., between the supporting roller 132 and the supporting roller 133, such that the toner image may be transferred from the photosensitive drum 100 to the transfer belt 131. The transfer roller 140 opposes the transfer belt 131. While the color toner image is being transferred from the photosensitive drum 100 onto the transfer belt 131, the transfer roller 140 may be spaced apart from the transfer belt 131, and when the color toner image is completely transferred onto the transfer belt 131, the transfer roller 140 may press against the transfer belt 131 so as to allow the color toner image to be transferred onto a printing medium passing through between the transfer belt 131 and the transfer roller 140. The supporting roller 136 opposes the transfer roller 140 while the transfer belt 131 is interposed between the supporting roller 136 and the transfer roller 140.

The power supply source 150 may serve to apply a developing bias voltage of a predetermined magnitude to the respective developing units 110, more particularly, to the developing rollers 111. The power supply source 150 may be configured to supply a first developing bias voltage of only a DC voltage and/or a second developing bias voltage of a DC voltage overlapped with an AC voltage.

The density sensing part 160 includes a toner density sensor. After an image of a predetermined size is exposed to light, and is developed with toner on the photosensitive drum 100, the toner density sensor irradiates an infrared ray to the developed image, and senses an intensity of light reflected from the image and/or the non-image region. The intensity of the reflected light is in proportion to the developer amount, and the toner density sensor converts the intensity of the reflected light into an output electric signal. For example, a color toner density (CTD) sensor may be used as the toner density sensor.

In the image forming apparatus as constituted above, toner images of cyan (C), magenta (M), yellow (Y) and black (K) are sequentially overlapped on the transfer belt 131 in a preset order, and then are transferred and fused onto the paper, thereby forming a color image. The outer surface of the photosensitive drum 100 is charged to a uniform electric potential by the charging unit 101. When an optical signal corresponding to image information of cyan (C) is scanned to the rotating photosensitive drum 100 by the exposure unit 120, in the portions exposed to the light, an electric charge is generated in the charge generating layer, and moves to the surface of the photosensitive drum 100 through the charge transport layer, thereby decreasing the surface potential. Accordingly, an electric potential difference between the light exposed portions and the remaining portions of the photosensitive drum 100 is created. As a result, an electrostatic latent image is formed on the outer surface of the photosensitive drum 100. If the electrostatic latent image approaches the cyan developing unit 110C while the photosensitive drum 100 rotates, the developing roller 111C of the cyan developing unit 110C starts rotating. The power supply source 150 applies the developing bias to the developing roller 111C of the cyan developing unit 110C. Only the toner of cyan is attached to the electrostatic latent image formed on the outer peripheral surface of the photosensitive drum 100 across the developing gap Dg, and thus a toner image of cyan is formed. As the toner image of cyan approaches the transfer belt 131 by the rotation of the photosensitive drum 100, the toner image is transferred onto the transfer belt 131 by the contact pressure between the photosensitive drum 100 and the transfer belt 131. After the toner image of cyan is completely transferred onto the transfer belt 131, toner images of magenta, yellow and black are also transferred onto the transfer belt 131 to overlap one another through the above-described processes. If all of the toner images of four colors are transferred onto the transfer belt 131 thus completing a color toner image on the transfer belt 131, the transfer roller 140 presses against the transfer belt 131 to transfer the color toner image onto a printing medium that passes between the transfer belt 131 and the transfer roller 140. Subsequently, a fusing unit fuses the color toner image to the printing medium by using heat and pressure, thereby completing a color image formation.

As described above, in the image forming apparatus using, e.g., two component developer, the electrostatic latent image formed on the photosensitive drum 100 is developed by the use of only the toner particles. It is thus important to replenish the toner as it is being consumed to maintain the toner density within an adequate range.

To that end, according to an embodiment, the same image pattern is developed first using a DC developing method, in which a developing bias voltage of only a DC voltage component is applied, and then using an AC+DC developing method, in which a developing bias voltage of both DC voltage and AC components. The toner density control is implemented on the basis of both of the respective density of the image pattern developed under the above two development processes to reduce the possibility of an excessive supply of toner, and thus the occurrences of toner scattering, and/or background contamination.

The image forming apparatus further comprises a control unit (not shown) that may control various components of the image forming apparatus, e.g., one or more of the photosensitive medium 100, the developing units 110, the exposure unit 120, the intermediate transfer unit 130, the transfer roller 140, the power supply source 150 and the density sensing part 160, to control various printing operations of the image forming apparatus, and to implement the various control operations herein described. To this end, according to an embodiment, the control unit may be, e.g., a microprocessor, a microcontroller or the like, that includes a CPU to execute one or more computer instructions to implement the various control operations herein described, including the processes shown in FIG. 5 hereof, and may further include a memory device, e.g., a Random Access Memory (RAM), Read-Only-Memory (ROM), a flesh memory, or the like, to store the one or more computer instructions.

Figure 2:
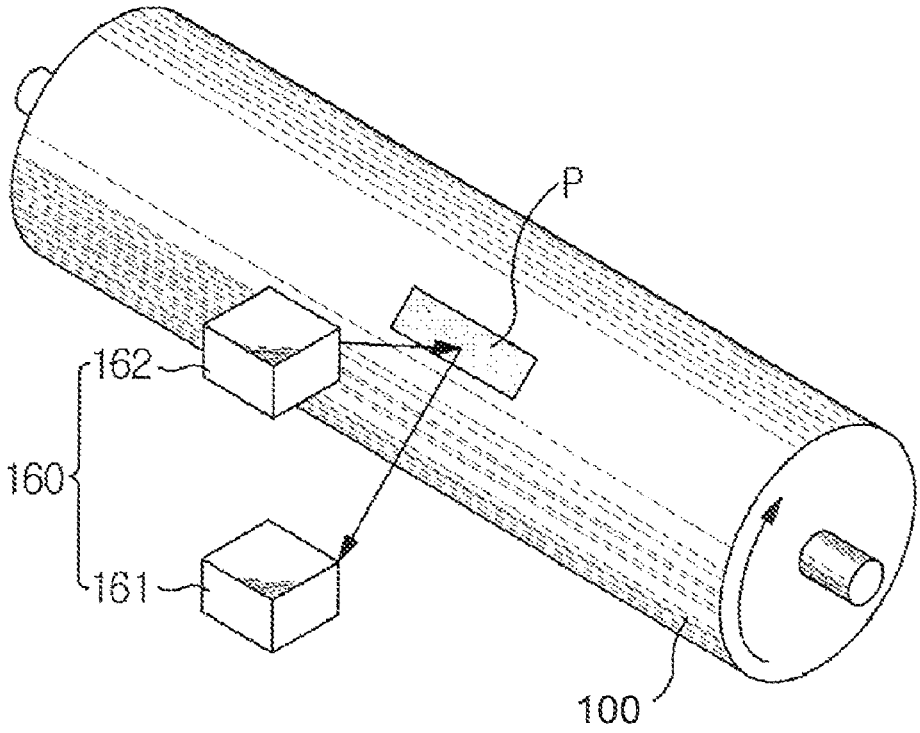
FIG. 2 is a perspective view illustrating an image pattern formation and a density sensing in the image forming apparatus according to an embodiment of the present invention.

As shown in FIG. 2, a predetermined image pattern P is formed on the photosensitive drum 100 by the exposure unit 120, to sense the toner density.

The image pattern P formed on the photosensitive drum 100 is developed by the developing roller 111. The developed image pattern P is transferred onto the transfer belt 131 which runs between the photosensitive drum 100 and the transfer roller 140. The density sensing part 160 irradiates an infrared ray at source 162 to the image pattern on the photosensitive drum 100 or the transfer belt 131, and converts the light reflected from the image pattern into an electric signal by use of a light receiving element 161, such as a photo diode, thereby sensing density of the image pattern.

The image pattern P formed on the photosensitive drum 100 may be initially developed using one of the two development processes described above, e.g., by applying only the DC component developing bias voltage into an image pattern of relatively low density, and may then be transferred onto the transfer belt 131. The density sensing part 160, depending on the particular configuration, can be made to sense the density of the image pattern either from the photosensitive drum 100 or from the transfer belt 131. Thereafter, the image pattern P formed on the photosensitive drum 100 may be developed into an image pattern of relatively high density by the developing roller 111 to which a developing bias voltage of both a DC and an AC voltage components is applied, and then is transferred onto the transfer belt 131. The density sensing part 160 again senses the density of the image pattern on either the photosensitive drum 100 or the transfer belt 131.

By using two different density values with respect to the same image pattern sensed as described above, the control of toner density can account for the possibility of the increase in the charge of developer.

Figure 3:
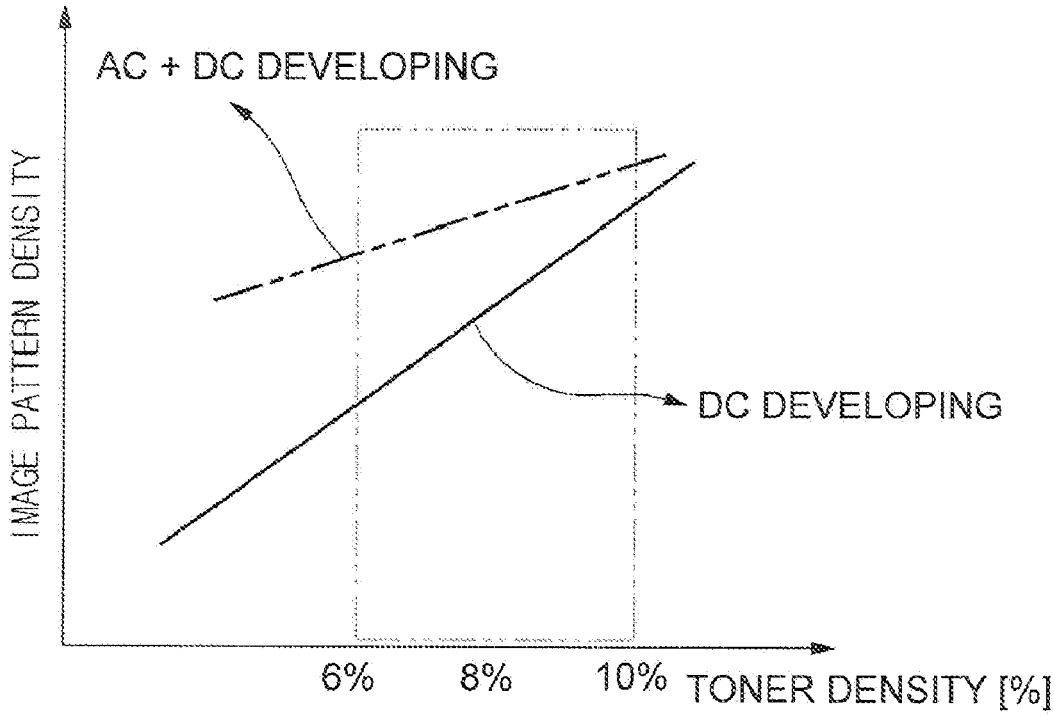
FIG. 3 is a graph showing density variations of an image pattern developed by using two different developing bias voltages with respect to toner density according to an embodiment of the present invention.
Figure 4:
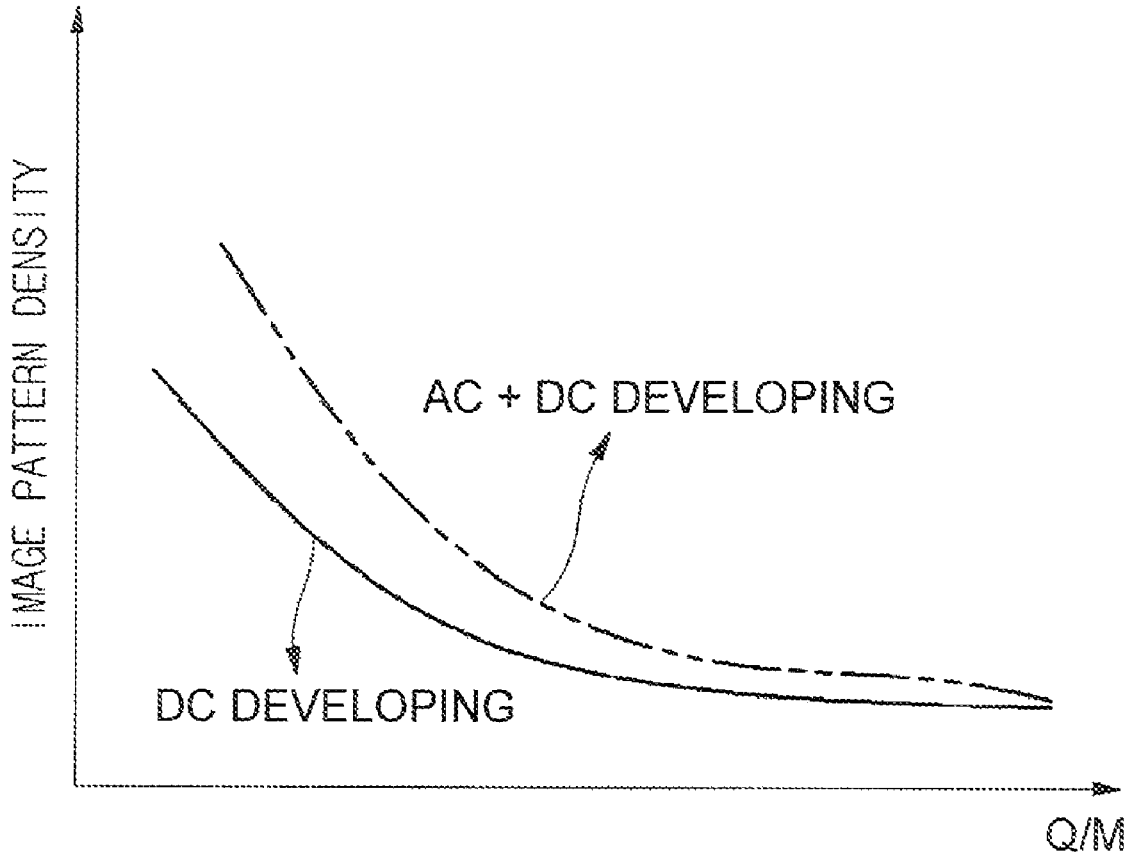
FIG. 4 is a graph showing density variations of an image pattern developed by using two different developing bias voltages with respect to charge of a developer according to an embodiment of the present invention.

FIG. 3 is a graph showing density variations of the image pattern developed by using the two different developing bias voltages as above described with respect to toner density. FIG. 4 is a graph showing density variations of the image pattern developed by using the two different developing bias voltages with respect to charge of a developer.

As shown in FIG. 3, as the toner density is increased, the image pattern density is increased. Further, in a specific range of toner density, the density variation of the image pattern developed with the AC+DC developing bias voltage is smaller than the density variation of the image pattern developed with only DC component developing bias voltage. For example, when the toner density is in the range of 6 to 10%, it can be seen that the density variation of the image pattern from the AC+DC developing bias is smaller than the density variation of the image pattern from the DC only developing bias. Based on the difference of the image pattern density between the DC bias only development and the AC+DC development, information with respect to the toner density level can be gained, and can be used to determine whether additional toner is to be supplied.

It can be seen from FIG. 4 that as the charge of a developer Q/M increases, the image pattern density for both the AC+DC developing bias and the DC developing bias tend to decrease. If the charge of the developer Q/M is sufficiently large, there is virtually no difference of image pattern density between the above two developing processes. That is, when the charge of the developer Q/M is large, because there is little difference of image pattern density resulting from the two developing biases, the image pattern density drops even when the toner density may be in the proper range. In such situation, because it is difficult to adjust the image pattern density by supplying additional toner, the control for increasing the image pattern density may be implemented by adjusting the development condition, such as, e.g., the developing bias voltage, the latent image condition, such as, e.g., the latent image voltage, or the like.

Figure 5:
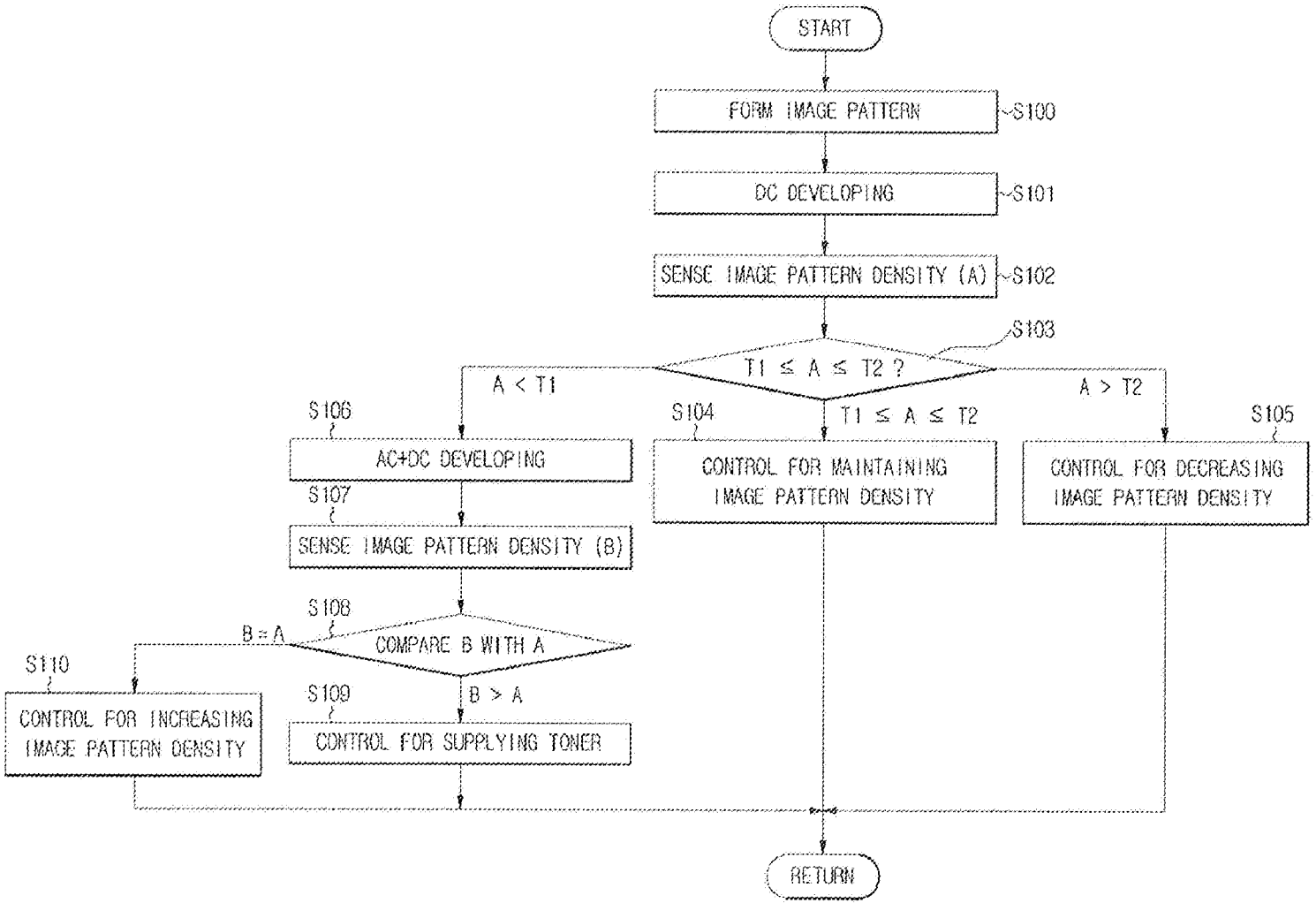
FIG. 5 is a control flow chart for an example method of controlling the image forming apparatus according to an embodiment of the present invention.

FIG. 5 shows an example of control method for an image forming apparatus according an embodiment. Referring to FIG. 5, the image pattern is first formed on the photosensitive drum 100 by the exposure unit 120 at operation S100.

The image pattern is developed by applying a developing bias voltage having only a DC voltage component from the power supply source 150 to the developing roller 111 at operation S101.

The density sensing part 160 senses density of the image pattern developed on the photosensitive drum 100 (or the image pattern transferred onto the transfer belt 131 in a case where the density sensing part is provided to sense density of the image pattern from the transfer belt 131) at operation S102.

Thereafter, it is determined whether the sensed first density value (A) of the image pattern is within a preset effective range at operation S103. From the determination result at operation S103, if the first density value (A) of the image pattern is within the preset effective range ($T1 \leqq A \leqq T2$), the control processes for maintaining the current image pattern density is performed at operation S104.

On the other hand, if the first density value (A) of the image pattern is determined to exceed the upper limit value (T2) of the preset effective range (i.e., $A > T2$), the control procedures for decreasing the image pattern density is performed at operation S105. The control procedure of decreasing the image pattern density may include, e.g., adjusting at least one of the developing bias voltage of the developing unit 110 and the latent image voltage of the photosensitive drum 100.

If it is determined, during operation S103, that the first density value (A) of the image pattern is less than a lower limit value (T1) of the preset effective range (i.e., $A < T1$), the image pattern is again developed by applying a developing bias voltage of both DC and AC voltages from the power supply source 150 to the developing roller 111 at operation S106.

Thereafter, the density sensing part 160 senses density of the image pattern developed on the photosensitive drum 100 (or the image pattern transferred onto the transfer belt 131) at operation S107.

Thereafter, at operation S108, the sensed second density value (B) of the image pattern is compared with the first density value (A) of the image pattern sensed at operation S102. Based on the result of the comparison at operation S108, if the second density value (B) of the image pattern is higher than the first density value (A) of the image pattern (i.e., $B > A$), it is determined that the toner supply in the developing unit is running low, and the control for supplying additional toner to the developing unit is performed at operation S109.

On the other hand, if it was determined during operation S108 that the second density value (B) of the image pattern is approximately the same as the first density value (A) of the image pattern, the control processes for increasing the image pattern density is performed at operation S110, which may include, e.g., adjusting at least one of the developing bias voltage of the developing unit 110 and the latent image voltage of the photosensitive drum 100.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method for controlling an image forming apparatus, the image forming apparatus including a photosensitive medium configured to support an electrostatic latent image thereon and a developing unit configured to supply toner to the photosensitive medium to develop the electrostatic latent image into a toner image, comprising:

developing an image pattern into a first toner image by applying a first developing bias voltage that consists of a direct current (DC) voltage to the developing unit;

developing the image pattern into a second toner image by applying a second developing bias voltage that comprises an alternating current (AC) voltage to the developing unit;

sensing a first image pattern density associated with the first toner image;

sensing a second image pattern density associated with the second toner image; and controlling a level of an image pattern density of the image forming apparatus based on the first image pattern density and the second image pattern density.

2. The method according to claim 1, wherein the image forming apparatus includes a transfer belt onto which the toner image is transferred from the photosensitive medium, and wherein each of the steps of sensing the first image pattern density and the second image pattern density comprises:

directing a light onto a respective one of the first toner image and the second toner image formed on the transfer belt; and receiving the light reflected from the respective one of the first toner image and the second toner image.

3. The method according to claim 1, further comprising:

determining whether the first image pattern density is within a range of density values ranging between a minimum density value and a maximum density value.

4. The method according to claim 3, wherein the step of controlling the level of the image pattern density comprises:

decreasing the level of the image pattern density if the first image density is determined to be larger than the maximum density value.

5. The method according to claim 4, wherein the step of decreasing image pattern density comprises:

adjusting at least one of a developing bias voltage applied to the developing unit and a latent image voltage of the photosensitive medium.

6. The method according to claim 3, wherein the step of controlling the level of the image pattern density comprises:

if the first image density is determined to be smaller than the minimum density value, comparing the first image pattern density with the second image pattern density; and if the second image pattern density is larger than the first image pattern density, causing additional toner to be supplied to the developing unit to increase the level of the image pattern density.

7. The method according to claim 6, wherein the step of controlling the level of the image pattern density further comprises:

increasing the level of the image pattern density of the image forming apparatus if the first image pattern density is determined to be substantially equal to the second image pattern density.

8. The method according to claim 7, wherein the step of increasing the level of the image pattern density comprises:

adjusting at least one of a developing bias voltage applied to the developing unit and a latent image voltage of the photosensitive medium.

9. A method for controlling an image forming apparatus, the image forming apparatus including a photosensitive medium configured to support an electrostatic latent image thereon and a developing unit configured to supply toner to the photosensitive medium to develop the electrostatic latent image into a toner image, comprising:

forming a latent image pattern on the photosensitive medium;

developing the latent image pattern into a first toner image by applying a first developing bias voltage that consists of a direct current (DC) voltage to the developing unit;

sensing a first image pattern density associated with the first toner image;

determining whether the first image pattern density is less than a minimum density value;

if the first image pattern density is determined to be less than the minimum density value, developing the latent image pattern into a second toner image by applying a second developing bias voltage that comprises an alternating current (AC) voltage to the developing unit; and controlling a level of an image pattern density of the image forming apparatus based on a result of a comparison of the first image pattern density with the second image pattern density.

10. The method according to claim 9, wherein the step of controlling the level of the image pattern density comprises:

if the second image pattern density is larger than the first image pattern density, causing additional toner to be supplied to the developing unit to increase the level of the image pattern density.

11. The method according to claim 9, wherein the step of controlling the level of the image pattern density comprises:

increasing the level of the image pattern density of the image forming apparatus if the first image pattern density is determined to be substantially equal to the second image pattern density.

12. The method according to claim 11, wherein the step of increasing the level of the image pattern density comprises:

adjusting at least one of a developing bias voltage applied to the developing unit and a latent image voltage of the photosensitive medium.

13. An image forming apparatus, comprising:

a photosensitive medium configured to support an electrostatic latent image thereon;

a developing unit configured to supply toner to the photosensitive medium to develop the electrostatic latent image into a toner image;

an image pattern density sensor configured to sense a density of the toner image, the image pattern density sensor having an output through which to output an image pattern density signal based on the sensed density of the toner image; and a controller configured to receive from the image pattern density sensor the image pattern density signal, the controller being configured to cause a latent image pattern to be formed on the photosensitive medium, to cause the latent image pattern into a first toner image by applying a first developing bias voltage that consists of a direct current (DC) voltage to the developing unit and a second toner image by applying a second developing bias voltage that comprises an alternating current (AC) voltage to the developing unit, the controller being further configured to control a level of an image pattern density of the image forming apparatus based on a result of a comparison of the first image pattern density with the second image pattern density.

14. The image forming apparatus according to claim 13, wherein the controller is further configured to cause additional toner to be supplied to the developing unit to increase the level of the image pattern density if the second image pattern density is larger than the first image pattern density.

15. The image forming apparatus according to claim 13, wherein the controller is further configured to cause an increase in the level of the image pattern density of the image forming apparatus if the first image pattern density is determined to be substantially equal to the second image pattern density.

16. The image forming apparatus according to claim 15, wherein the controller is further configured to cause an adjustment of at least one of a developing bias voltage applied to the developing unit and a latent image voltage of the photosensitive medium to be made to increase the level of image pattern density of the image forming apparatus.

17. The image forming apparatus according to claim 13, wherein the image pattern density sensor comprises:

a light source disposed to produce a light, and to direct the light toward the toner image formed on the photosensitive medium, and a light detector configured to receive the light reflected the toner image.

18. The image forming apparatus according to claim 17, wherein the light source comprises an infrared light source.

19. The image forming apparatus according to claim 13, further comprising:

a transfer belt in pressing contact with the photosensitive medium such that the toner image is transferred to the transfer belt from the photosensitive medium, wherein the image pattern density sensor comprises:

a light source disposed to produce a light, and to direct the light toward the toner image formed on the transfer belt, and a light detector configured to receive the light reflected the toner image.

20. The image forming apparatus according to claim 19, wherein the developing unit comprises a plurality of developing units each developing the toner image in respective one of a plurality of colors, the transfer belt receiving from each of the plurality of developing units the toner image of the respective one of plurality of colors, and to support a color toner image comprising overlapping together of each of the toner image in respective one of the plurality of colors.

* * * * *